US006616552B2

(12) United States Patent
Takesue et al.

(10) Patent No.: US 6,616,552 B2
(45) **Date of Patent: *Sep. 9, 2003**

(54) GOLF BALL

(75) Inventors: Rinya Takesue, Chichibu (JP); Yasushi Ichikawa, Chichibu (JP); Shunichi Kashiwagi, Chichibu (JP); Nobuhiko Sato, Chichibu (JP)

(73) Assignee: Bridgestone Sports Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/534,565

(22) Filed: Mar. 27, 2000

(65) Prior Publication Data

US 2003/0004011 A1 Jan. 2, 2003

(30) Foreign Application Priority Data

Mar. 30, 1999 (JP) ..... 11-087732

(51) Int. Cl.[7] ..... A63B 37/12; A63B 37/14; A63B 37/00; C08G 63/48; C08G 63/91

(52) U.S. Cl. ..... 473/378; 473/351; 525/7

(58) Field of Search ..... 473/351, 361, 473/365, 368, 370, 371, 373, 374, 377, 378; 524/400, 399, 398, 908; 525/10, 7, 7.1

(56) References Cited

U.S. PATENT DOCUMENTS

| | | | | |
|---|---|---|---|---|
| 3,404,134 A | | 10/1968 | Rees | |
| 3,959,539 A | | 5/1976 | Waggoner | |
| 4,526,375 A | | 7/1985 | Nakade | |
| 4,984,804 A | | 1/1991 | Yamada et al. | |
| 4,999,404 A | | 3/1991 | Matsuki | |
| 5,019,320 A | | 5/1991 | Hasegawa et al. | |
| 5,274,041 A | * | 12/1993 | Yamada | 525/196 |
| 5,306,760 A | * | 4/1994 | Sullivan | 273/DIG. 22 |
| 5,312,857 A | | 5/1994 | Sullivan | |
| 5,439,227 A | | 8/1995 | Egashira et al. | |
| 5,559,188 A | | 9/1996 | Egashira et al. | |
| 5,605,968 A | | 2/1997 | Egashira et al. | |
| 5,779,561 A | | 7/1998 | Sullivan et al. | |
| 5,803,831 A | | 9/1998 | Sullivan et al. | |
| 5,824,740 A | | 10/1998 | Yabuki et al. | |
| 5,902,855 A | | 5/1999 | Sullivan | |
| 5,929,189 A | | 7/1999 | Ichikawa et al. | |
| 5,948,859 A | | 9/1999 | Sano et al. | |
| 5,994,470 A | | 11/1999 | Tanaka et al. | |
| 6,018,003 A | | 1/2000 | Sullivan et al. | |
| 6,034,182 A | | 3/2000 | Kashiwagi et al. | |
| 6,100,321 A | | 8/2000 | Chen | |
| 6,319,153 B1 | | 11/2001 | Nesbitt et al. | |
| 6,325,731 B1 | | 12/2001 | Kennedy, III et al. | |
| 6,329,458 B1 | | 12/2001 | Takesue et al. | |

FOREIGN PATENT DOCUMENTS

| | | |
|---|---|---|
| GB | 1113409 | 5/1968 |
| JP | 4-156865 | 5/1992 |
| JP | 5-3931 | 1/1993 |
| JP | 9-117532 | 5/1997 |
| JP | 9-313643 | 12/1997 |
| JP | 10-305114 | 11/1998 |
| WO | 00/23519 A1 | 4/2000 |
| WO | 01/29129 A1 | 4/2001 |

OTHER PUBLICATIONS

R. Longworth and D.J. Vaughn, *Nature*, vol. 218, pp. 85–87 (Apr. 6, 1968).
Hirosawa, Kobunshi Kako (Polymer Processing), 473, 1978.

* cited by examiner

*Primary Examiner*—Sebastiano Passaniti
*Assistant Examiner*—Alvin A. Hunter, Jr.
(74) *Attorney, Agent, or Firm*—Sughrue Mion, PLLC

(57) ABSTRACT

In a golf ball including a core and a cover of at least one layer, the cover layer is formed of a heated mixture of an ionomer resin and a metal salt such as magnesium stearate. The heated mixture exhibits such a crystal melting behavior that when measured by DSC, the difference between first and second peak temperature is up to 30° C. The ball is improved in resilience.

13 Claims, 1 Drawing Sheet

GOLF BALL

This invention relates to a golf ball having improved resilience.

BACKGROUND OF THE INVENTION

In the related art, ionomer resins are widely used as the cover material of golf balls. Ionomer resins are ionic copolymers between olefins (such as ethylene) and unsaturated carboxylic acids (such as acrylic acid, methacrylic acid and maleic acid), wherein some of the acidic groups are neutralized with metal ions such as sodium, lithium, zinc and magnesium. On account of excellent properties including durability, resilience, and scuff resistance, ionomer resins are advantageously used as the base resin of cover materials, and actually become the mainstream of the current cover resins. Although the rebound of ionomer resins is considerably high, the customers are eager to play with golf balls of higher resilience and better flight performance.

One method for improving the resilience of golf balls using ionomer resins as the cover material is disclosed in JP-A 4-156865. A golf ball is improved in resilience by covering a core with an ionomer resin and annealing the ionomer resin under suitable conditions to modify the crystallographic state thereof. The annealed ionomer resin exhibits such a crystal melting behavior that a first melting peak appears at 85 to 95° C. and a second melting peak appears at 70 to 80° C. when measured by a differential scanning calorimeter. More particularly, the ionomer resin as applied onto the core is annealed at 45 to 63° C. for about 3 to 240 hours. Then the crystallographic state of the ionomer resin is changed whereby the second melting peak temperature is raised to the range of 70 to 80° C., thereby improving resilience.

This method, however, requires annealing the ionomer resin-based cover material as applied onto the core. Holding the cover material at a high temperature for an extended period of time causes the core to harden. This hardening can prevent formation of a ball having desired physical properties. Additionally, since the annealing needs expensive equipment and takes a very long time, it is undesirable to adopt the annealing step in the golf ball manufacturing process.

SUMMARY OF THE INVENTION

An object of the invention is to provide a golf ball which is improved in resilience without a need for annealing the cover.

The invention is predicated on the following discovery. By adding a metal salt to an ionomer resin and heating and mixing them, a heated mixture is obtained. When the heated mixture is measured by a differential scanning calorimeter, a first melting peak and a second melting peak appear at different temperatures. Quite unexpectedly, a very high resilience is exerted when a heated mixture exhibiting such a crystal melting behavior that the difference between the first peak temperature and the second peak temperature up to 30° C. is used as the cover material of a golf ball.

More particularly, as is known from the model proposed by Longworth et al, the solid structure of an ionomer resin consists of three phases, crystalline zones 1 of polyethylene, amorphous zones 2 and ion cohered zones 3 as shown in FIG. 1 (See R. Longworth and D. J. Vaughan, Nature, 218, 85 (1968)). The ion cohered zones are composed of cations, carboxyl anions, and non-dissociated carboxyl groups and known as ion clusters. It is also known that the rigidity, toughness and excellent other properties of ionomer resins originate from ion neutralization (see Hirasawa, Kobunshi Kako (Polymer Processing), 473, 1978). It is then believed that the state of ion clusters largely affects the properties of a golf ball.

We investigated the influence of the ion cluster structure in an ionomer resin on the resilience thereof and the flight performance of a golf ball using that ionomer resin as the cover. It has been found that a golf ball having improved resilience is obtained when the cover is formed of a heated mixture of an ionomer resin and a metal salt which exhibits a crystal melting behavior that the difference between first and second peak temperatures is up to 30° C.

Accordingly, the invention provides a golf ball comprising a core and a cover of at least one layer enclosing the core, at least one layer of the cover being formed of a cover material comprising a heated mixture of an ionomer resin and a metal salt, the heated mixture exhibiting such a crystal melting behavior that when measured by a differential scanning calorimeter, the difference between a first peak temperature and a second peak temperature is up to 30° C.

BRIEF DESCRIPTION OF THE DRAWING

The only figure, FIG. 1 schematically illustrates the structure of an ionomer resin.

DESCRIPTION OF THE PREFERRED EMBODIMENT

Figure 1:
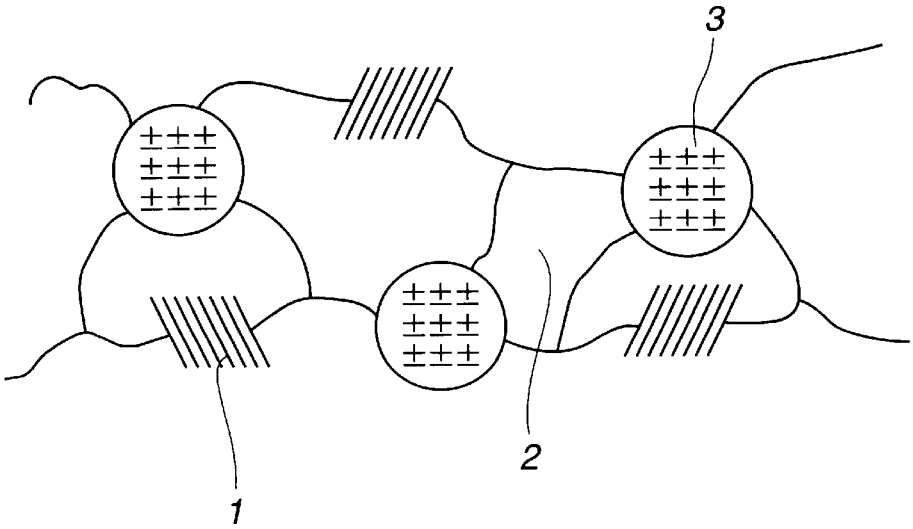

The golf ball of the invention includes a core and a cover of one or more layers enclosing the core. At least one layer of the cover is formed of a cover material comprising a heated mixture of an ionomer resin and a metal salt.

Ionomer resins are ionic copolymers between olefins such as ethylene and unsaturated carboxylic acids such as acrylic acid, methacrylic acid and maleic acid, wherein some acidic groups are neutralized with metal ions such as sodium, lithium, zinc and magnesium. The most widely used ionomer resins are ethylene-(meth)acrylic acid copolymers neutralized with metal ions. They have the structure that the molecular chain of polyethylene has carboxylic groups as side chains, some of which are crosslinked with metal ions between molecular chains.

The acid content of the ionomer resin is preferably 8 to 22% by weight and more preferably 10 to 20% by weight. An ionomer resin with an acid content of less than 8% is short of rigidity, with a possibility of increased spin and reduced distance upon driver shots. An ionomer resin with an acid content of more than 20% has a too high rigidity, probably exacerbating the feel of a ball when hit.

The metals with which the carboxylic acids in the ionomer resins are neutralized include $Na^+$, $K^+$, $Li^+$, $Zn^{++}$, $Cu^{++}$, $Mg^{++}$, $Ca^{++}$, $Co^{++}$, $Ni^{++}$, and $Pb^{++}$, with $Na^+$, $Li^+$, $Zn^{++}$ and $Mg^{++}$ being preferred. The degree of neutralization is preferably 20 to 80 mol %, and more preferably 25 to 75 mol %. A degree of neutralization of less than 20 mol % may provide a cover material with less rigidity, leading to a decline of resilience. A degree of neutralization of more than 80 mol % may detract from the flow and workability of a cover material. These metal ions are available in the form of such compounds as formic salts, acetic salts, nitric salts, carbonic salts, hydrogencarbonates, oxides, hydroxides, and alkoxides.

Commercially available ionomer resins commonly used as the golf ball cover stock can be used herein, for example, Himilan 1706, 1605, 1557 and 1601 by Dupont-Mitsui Polychemical K.K. and Surlyn 7930 by E. I. Dupont. Also, low-rigidity ionomer resins in the form of ethylene-(meth) acrylic acid-(meth)acrylate terpolymers neutralized with metal ions are useful for improving the shock of a golf ball when hit. Such ternary ionomer resins are commercially available as Himilan 1855 and 1856 from Dupont-Mitsui Polychemical K.K. and Surlyn 8120 and 8542 from E. I. Dupont.

As the base resin of the cover material, ionomer resins may be used alone or in a blend of two or more.

The metal salts used herein are salts of metal ions with counter anions. Exemplary metal ions include $Li^+$, $K^+$, $Na^+$, $Ca^{++}$, $Mg^{++}$, $Zn^{++}$, $Mn^{++}$, $Al^{+++}$, $Ni^{++}$, $Fe^{++}$, $Fe^{+++}$, $Cu^{++}$, $Mn^{++}$, $Sn^{++}$, $Pb^{++}$, and $Co^{++}$. According to the invention, the ion cluster structure of the ionomer resin is altered by exchanging the proton of acid groups in the ionomer resin with the metal ion of the metal salt. This exchange becomes more efficient with a metal having a greater ionization tendency. It is preferred to use an ion of a metal having a standard electrode potential of not greater than −2 volts, more preferably not greater than −2.5 volts, and most preferably not greater than −3 volts. Such preferred metal ions are $Li^+$, $K^+$, $Ca^{++}$, $Na^+$and $Mg^{++}$. It is noted that the standard electrode potential is a quantitative expression of the ionization tendency.

Exemplary counter anions include $OH^-$, $O^{2-}$, and $RCOO^-$ wherein R is an organic group. Of these, $RCOO^-$ is preferred for dispersion in and reactivity with ionomer resins. $RCOO^-$ anions are available from organic acids (RCOOH), which are classified into aliphatic, aromatic and alicyclic organic acids depending on the type of organic group. Typically aliphatic organic acids (that is, fatty acids) are used. The fatty acids each consist of a highly hydrophobic hydrocarbon group and a hydrophilic carboxyl group. They may be either unsaturated fatty acids bearing a double or triple bond in the hydrocarbon group, or saturated fatty acids whose hydrocarbon group consists of single bonds. The hydrocarbon groups of the fatty acids preferably have 6 to 24 carbon atoms, more preferably 12 to 18 carbon atoms, and most preferably 12 to 16 carbon atoms. Hydrocarbon groups of less than 6 carbon atoms may lead to a decline of thermal stability. With hydrocarbon groups of more than 24 carbon atoms, the metal content may become relatively low, leading to a drop of reactivity with the ionomer resin.

Examples of the fatty acid include caproic acid, caprylic acid, capric acid, lauric acid, myristic acid, palmitic acid, stearic acid, arachidic acid, behenic acid, lignoceric acid, myristoleic acid, palmitoleic acid, oleic acid, linoleic acid, linolenic acid, 12-hydroxystearic acid, and ricinoleic acid. Of these, stearic acid, palmitic acid, myristic acid and lauric acid are preferred.

The metal salts resulting from neutralization of metal ions with fatty acids are in widespread use as metal soaps. Commercially available metal soaps can be used herein. Examples of the metal soaps include magnesium stearate, calcium stearate, lithium stearate, sodium stearate, magnesium palmitate, calcium palmitate, magnesium myristate, calcium myristate, magnesium laurate, and calcium laurate.

The metal salt is blended with the ionomer resin in such amounts that the difference in first and second peak temperatures in differential scanning calorimetry (DSC) may be 30° C. or less. Usually, 0.5 to 100 parts by weight of the metal salt is used per 100 parts by weight of the ionomer resin although the addition amount of the metal salt is properly adjusted in accordance with the metal content and type of the metal salt. In one example wherein magnesium stearate is added to an ionomer resin, an appropriate amount of the metal salt is 2 to 25 parts, more preferably 4 to 20 parts by weight per 100 parts by weight of the ionomer resin. The addition of more than 25 parts of magnesium stearate means that magnesium stearate is greater than the equivalent amount of non-dissociated carboxylic acid in the ionomer resin, probably failing to achieve the resilience improving effect. Also, when a salt of a metal element of a smaller atomic weight having a greater metal content than magnesium stearate is used, the amount of this metal salt blended may be smaller than the above-described amount. Inversely, when a salt of a metal element of a larger atomic weight having a lower metal content is used, the amount of this metal salt blended may be larger than the above-described amount.

The cover material used herein contains a heated mixture which is obtained by heating and mixing the ionomer resin and the metal salt. On analysis by differential scanning calorimetry (DSC), the heated mixture must show first and second peak temperatures the difference between which is 30° C. or less, preferably 28° C. or less, and more preferably 26° C. or less. The lower limit of this difference is usually about 10° C.

Conditions used in mixing the ionomer resin and the metal salt include a temperature of about 150 to 250° C. and a time of about ½ to about 15 minutes. The mixers used herein include internal mixers such as kneading twin-screw extruders, Banbury mixers, and kneaders. The method of adding various additives other than the essential components is not critical. One exemplary method entails blending additives together with the essential components, followed by simultaneous heating and mixing. Also useful is a method of previously heating and mixing the essential components, and adding the additives thereto, followed by further heating and mixing.

It is recommended that the heated mixture have a specific gravity of 0.9 to 1.5, more preferably 0.9 to 1.3, and further preferably 0.9 to 1.1 though not critical.

The conditions under which the heated mixture is analyzed by differential scanning calorimetry (DSC) using a differential scanning calorimeter are not critical. In one typical procedure, a cover resin containing the heated mixture is injection molded to form a golf ball cover, which is held at 23° C. for a certain period of time. A cover resin sample of about 5 mg is cut out of the cover. The cover resin sample is cooled down to 0° C. in a nitrogen atmosphere, then heated at a ramp rate of 10° C./min to 150° C. while it is analyzed by DSC. There is obtained a DSC curve having two endothermic peaks (at high and low temperatures). The high temperature peak is a first melting peak (Tm) associated with fusion of polyethylene crystals, and the low temperature peak is a second melting peak (Ti) associated with fusion of an ordered structure (ionic crystals) contained in the ion cluster. It is presumed that the Ti peak changes with the state of the ion cluster. Ti becomes higher when the degree of ionization of the ionomer resin is high or the cohesive force of neutralizing ions is high. With respect to polyethylene crystals in the ionomer resin, it is presumed that the ion cluster restrains crystallization. Then, Tm becomes lower when the degree of ionization is high or the cohesive force of neutralizing ions is high. The invention entails adding the metal salt to the ionomer resin and heating and mixing them, accelerating formation of ion clusters in the heated mixture, thereby reducing the difference between Tm and Ti to less than 30° C. This results in an improved rebound and improved flight performance.

In the cover material used herein, various additives may be compounded in addition to the essential components. Such suitable additives include pigments, dispersants, antioxidants, UV absorbers, and photo-stabilizers.

The golf ball of the invention has a cover formed of the above-described cover material. Included are wound golf balls and solid golf balls such as two-piece, three-piece and multi-piece solid golf balls. As long as a core is enclosed with a cover, the cover structure and the type of the core are not critical. In manufacturing the golf ball of the invention, ball components other than the cover may be prepared by well-known methods. Therefore, the golf ball of the invention can be manufactured by preparing a wound core or solid core in accordance with a conventional technique, and applying the cover material onto the core surface so as to concentrically enclose the core.

For example, the solid center of wound golf balls or the solid core of solid golf balls is prepared as follows. A rubber composition is first prepared by compounding 100 parts by weight of cis-1,4-polybutadiene with 10 to 60 parts by weight of at least one vulcanizing or crosslinking agent selected from α, β-monoethylene unsaturated carboxylic acids such as acrylic acid and methacrylic acid or metal salts thereof and functional monomers such as trimethylol propane methacrylate, 5 to 30 parts by weight of a filler such as zinc oxide or barium sulfate, 0.5 to 5 parts by weight of a peroxide such as dicumyl peroxide, and optionally, 0.1 to 1 part by weight of an antioxidant. By press vulcanization (or crosslinking) or by heat compression molding at 140 to 170° C. for 10 to 40 minutes, the rubber composition is molded into a spherical body. The liquid center of wound golf balls may be prepared by forming a hollow spherical center bag from the above-mentioned rubber composition and introducing a fluid into the bag by a well-known technique.

The core of wound golf balls is obtained by winding thread rubber under tension around the solid or liquid center prepared by the above procedure. The thread rubber used herein may be conventional one, for example, one obtained by compounding natural rubber or synthetic rubber such as polyisoprene with additives such as an antioxidant, vulcanization accelerator and sulfur and molding and vulcanizing the rubber compound.

The diameter, weight, hardness and other parameters of the above-mentioned solid center, liquid center, solid core, and wound core are not critical and may be properly adjusted within the range for allowing the objects of the invention to be achieved.

The golf ball of the invention has the core enclosed with a cover of the cover material while the cover may be a single layer or a multilayer cover of two or more layers. The single layer cover is formed using the heated mixture. In the latter case, it suffices that at least one layer of the multilayer structure is formed using the heated mixture. The layer formed of the heated mixture may be disposed at any position within the multilayer structure. It is preferred that the inner layer of the two-layer cover is formed of the heated mixture.

When the cover layer is formed of the heated mixture, the resin component may consist solely of the heated mixture or be a combination of the heated mixture with another ionomer resin or thermoplastic elastomer. In the latter case, the heated mixture should preferably account for at least 60% by weight, more preferably at least 80% by weight of the resin component.

In the case of the two-layer structure cover, it is preferred in view of the paint receptivity of cover material that the cover inner layer be formed of the heated mixture as mentioned above and the cover outer layer be formed of ionomer resins or thermoplastic elastomers.

The hardness of the cover layer formed of the heated mixture varies with the particular type of ionomer resin used and is not critical, although it is preferably in the range of 40 to 70 in Shore D hardness. In the two-layer cover embodiment, the cover inner layer formed of the heated mixture preferably has a Shore D hardness of 40 to 70, and the cover outer layer preferably has a Shore D hardness of 40 to 70, more preferably 40 to 65.

While the thickness of the cover is not critical it is preferably in the range of 1 to 4 mm, especially 1.2 to 3.5 mm. In the multilayer cover embodiment, the layer formed of the heated mixture should preferably have a thickness of at least 1.2 mm, especially 1.5 to 2.5 mm in order that the heated mixture exert its effect.

In forming the cover, well-known techniques may be employed. One exemplary process involves the steps of preforming a cover material based on the heated mixture into a pair of hemispherical half shells, and encasing a core in the shells, followed by compression molding at 120 to 170° C. for 1 to 5 minutes. In an alternative process, a core is placed in a mold and the cover material is injected around the core.

A plurality of dimples are typically formed on the surface of the thus constructed golf ball cover. The cover surface is then subject to a series of treatments such as plasma treatment, stamping and painting. Of these treatments, the step of drying and curing a paint coating is delicate. Since drying and curing at elevated temperature for a long time can induce a significant change of the crystal melting behavior, this step should preferably be performed at low temperature for a short time, for example, at a temperature of 35 to 70° C. for a time of 20 minutes to 24 hours, especially at 40 to 60° C. for ½ to 8 hours.

The golf balls of the invention are suited for the competition use and comply with the Rules of Golf. They are constructed to a diameter of not less than 42.67 mm and a weight of not greater than 45.93 grams.

There have been described golf balls which are significantly improved in rebound while reserving the core attributes.

EXAMPLE

Examples of the invention are given below by way of illustration and not by way of limitation.

Examples 1–11 and Comparative Examples 1–6

Using a core material based on cis-1,4-polybutadiene, solid cores having a deflection of 3.1 mm under a load of 100 kg were prepared to a diameter of 38.6 mm and a weight of 35.1 grams.

Cover material ingredients of the composition shown in Tables 1 and 2 were mixed in a kneading twin-screw extruder at 200° C. for ½ minute, obtaining pellets of the cover material. With the core set in a mold, the cover material was injected into the mold, producing a two-piece solid golf ball of 42.8 mm diameter having a cover of 2.1 mm thick.

In Comparative Examples 2 and 6, the golf balls were annealed by holding them in a thermostat tank at 60° C. for 96 hours (four days).

The two-piece golf balls were examined for the properties listed below, with the results shown in Tables 1 and 2.

Example 12 and Comparative Examples 7–8

Using a core material based on cis-1,4-polybutadiene, solid cores having a deflection of 3.1 mm under a load of 100 kg were prepared to a diameter of 36.8 mm and a weight of 30.4 grams.

An inner cover material and an outer cover material as shown in Table 3 were successively injection molded around the core, producing a three-piece solid golf ball of 42.8 mm diameter.

In Comparative Example 8, the golf ball was annealed by holding it in a thermostat tank at 60° C. for 96 hours (four days).

The three-piece golf balls were examined for the properties listed below, with the results shown in Table 3.

Ball hardness a deflection (mm) of the ball under an applied load of 100 kg

Initial velocity

The initial velocity was measured in accordance with the procedure in the Rules of Golf using apparatus of the same type as approved by the USGA.

DSC

After a golf ball cover was injection molded, it was held at 23° C. for seven days (three days for Comparative Examples 2, 5 and 8). A cover resin sample of about 5 mg was cut out of the cover. The sample was cooled down to 0° C. in a nitrogen atmosphere, then heated at a ramp rate of 10° C./min to 150° C. while it was analyzed by DSC.

TABLE 1

| | E1 | E2 | E3 | E4 | CE1 | CE2 | CE3 | CE4 |
|---|---|---|---|---|---|---|---|---|
| Himilan 1705 | 50 | 50 | 50 | 50 | 50 | 50 | 50 | 50 |
| Himilan 1605 | 50 | 50 | 50 | 50 | 50 | 50 | 50 | 50 |
| Magnesium stearate | 15 | | | | | | | |
| Magnesium myristate | | 15 | | | | | | |
| Calcium stearate | | | 15 | | | | | |
| Lithium stearate | | | | 15 | | | | |
| Aluminum stearate | | | | | | | 15 | |
| Zinc stearate | | | | | | | | 15 |
| Titanium dioxide | 4 | 4 | 4 | 4 | 4 | 4 | 4 | 4 |
| Annealing time (hr) | 0 | 0 | 0 | 0 | 0 | 96 | 0 | 0 |
| Tm (° C.) | 92 | 92 | 91 | 91 | 94 | 93 | 94 | 94 |
| Ti (° C.) | 64 | 65 | 64 | 65 | 57 | 73 | 59 | 61 |
| Tm–Ti (° C.) | 28 | 27 | 27 | 26 | 37 | 20 | 35 | 33 |
| Cover specific gravity | 1.00 | 1.00 | 1.00 | 1.00 | 1.00 | 1.00 | 1.00 | 1.00 |
| Ball weight (g) | 45.2 | 45.2 | 45.2 | 45.2 | 45.2 | 45.2 | 45.2 | 45.2 |
| Ball hardness (mm) | 2.55 | 2.55 | 2.55 | 2.55 | 2.57 | 2.47 | 2.55 | 2.55 |
| Initial velocity (m/s) | 77.0 | 77.1 | 77.1 | 77.2 | 76.7 | 76.9 | 76.8 | 76.8 |

TABLE 2

| | E5 | E6 | E7 | E8 | E9 | E10 | E11 | CE5 | CE6 |
|---|---|---|---|---|---|---|---|---|---|
| Himilan 1855 | 50 | 50 | 50 | 50 | 50 | 50 | 50 | 50 | 50 |
| Surlyn 8120 | 50 | 50 | 50 | 50 | 50 | 50 | 50 | 50 | 50 |
| Magnesium stearate | 5 | 15 | 18 | | | | | | |
| Calcium laurate | | | | 3 | 10 | 15 | | | |
| Magnesium myristate | | | | | | | 15 | | |
| Titanium dioxide | 4 | 4 | 4 | 4 | 4 | 4 | 4 | 4 | 4 |
| Annealing time (hr) | 0 | 0 | 0 | 0 | 0 | 0 | 0 | 0 | 96 |
| Tm (° C.) | 81 | 80 | 80 | 81 | 80 | 79 | 80 | 82 | 81 |
| Ti (° C.) | 52 | 56 | 58 | 53 | 56 | 58 | 58 | 49 | 61 |
| Tm–Ti (° C.) | 29 | 24 | 22 | 28 | 24 | 21 | 22 | 33 | 20 |
| Cover specific gravity | 0.99 | 0.99 | 0.99 | 0.99 | 0.99 | 0.99 | 0.99 | 0.99 | 0.99 |
| Ball weight (g) | 45.2 | 45.2 | 45.2 | 45.2 | 45.2 | 45.2 | 45.2 | 45.2 | 45.2 |
| Ball hardness (mm) | 2.80 | 2.79 | 2.79 | 2.79 | 2.78 | 2.78 | 2.79 | 2.81 | 2.71 |
| Initial velocity (m/s) | 75.9 | 76.0 | 76.0 | 76.0 | 76.1 | 76.1 | 76.0 | 75.7 | 75.8 |

TABLE 3

| | | E12 | CE7 | CE8 |
|---|---|---|---|---|
| Cover inner layer | Himilan 1855 | 50 | 50 | 50 |
| | Surlyn 8120 | 50 | 50 | 50 |
| | Magnesium stearate | 15 | | |
| | Titanium dioxide | 4 | 4 | 4 |
| | Tm (° C.) | 80 | 82 | 81 |
| | Ti (° C.) | 56 | 49 | 61 |
| | Tm – Ti (° C.) | 24 | 33 | 20 |
| | Thickness (mm) | 1.5 | 1.5 | 1.5 |
| | Specific gravity | 0.99 | 0.99 | 0.99 |
| Cover outer layer | Himilan 1706 | 50 | 50 | 50 |
| | Himilan 1605 | 50 | 50 | 50 |
| | Titanium dioxide | 4 | 4 | 4 |
| | Thickness (mm) | 1.5 | 1.5 | 1.5 |
| | Specific gravity | 1.00 | 1.00 | 1.00 |
| Annealing time (hr) | | 0 | 0 | 96 |
| Ball weight (g) | | 45.2 | 45.2 | 45.2 |
| Ball hardness (mm) | | 2.68 | 2.59 | 2.59 |
| Initial velocity (m/s) | | 76.4 | 76.2 | 76.3 |

Himilan 1706

Zinc ionic ionomer, acid content 15 wt %, Shore D hardness 60, by Dupont-Mitsui Polychemical K.K.

Himilan 1605

Sodium ionic ionomer, acid content 15 wt %, Shore D hardness 61, by Dupont-Mitsui Polychemical K.K.

Himilan 1855

Zinc ionic ternary ionomer, acid content 10 wt %, Shore D hardness 54, by Dupont-Mitsui Polychemical K.K.

Surlyn 8120

Sodium ionic ternary ionomer, acid content 10 wt %, Shore D hardness 45, by E. I. Dupont Magnesium stearate magnesium stearate by Sakai Chemical K.K., metal content 4.1–5.1 wt %, magnesium's standard electrode potential −2.37 V Calcium Stearate calcium stearate by Sakai Chemical K.K., metal content 6.5–7.1 wt %, calcium's standard electrode potential −2.84 V Lithium Stearate lithium stearate by Sakai Chemical K.K., metal content 2.3–2.7 wt %, lithium's standard electrode potential −3.045 V Aluminum Stearate aluminum stearate by Sakai Chemical K.K., metal content 4.5–5.5 wt %, aluminum's standard electrode potential −1.662 V Zinc Stearate zinc stearate by Sakai Chemical K.K., metal content 10.0–11.0 wt %, zinc's standard electrode potential −0.7631 V Calcium Laurate calcium laurate by Sakai Chemical K.K., metal content 8.2–9.2 wt %

Magnesium Myristate magnesium myristate by Taihei Chemical K.K., metal content 4.5–6.0 wt %

It is evident from Tables 1 to 3 that the golf balls of Examples 1 to 11 whose cover is made of a cover material obtained by adding a metal salt to an ionomer resin and heat mixing them so that Tm-Ti is less than 30° C. are significantly improved in resilience as compared with the golf balls of Comparative Examples 1, 5 and 7 in which an ionomer resin is directly used as the cover material. As compared with the golf balls of Comparative Examples 2, 6 and 8 which are annealed, the golf balls of Examples 1 to 11 undergo a minimized drop of hardness, indicating that golf balls with good restitution can be rapidly manufactured at a low cost without losses of physical properties.

Japanese Patent Application No. 11-087732 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A golf ball, comprising:

a core; and a cover of at least one layer enclosing the core, said at least one layer being formed of a cover material comprising, a heated mixture of an ionomer resin, and a metal salt resulting from a neutralization of metal ions with fatty acids, said heated mixture, not subjected to annealing, exhibiting such a crystal melting behavior that when measured by a differential scanning calorimeter, a difference between a first peak temperature and a second peak temperature is up to 30° C., wherein an amount of said metal salt resulting from neutralization of metal ions with said fatty acids is 2 to 25 parts by weight per 100 parts by weight of said ionomer resin.

2. The golf ball of claim 1, the cover comprising:

an inner layer; and an outer layer, the inner layer being formed of said cover material comprising the heated mixture.

3. The golf ball of claim 1, wherein said metal salt resulting from neutralization of metal ions with fatty acids is selected from a group consisting of: magnesium stearate, calcium stearate, lithium stearate, sodium stearate, magnesium palmitate, calcium palmitate, magnesium myristate, calcium myristate, magnesium laurate, and calcium laurate.

4. The golf ball of claim 1, wherein a metal of said metal salt has a standard electrode potential of up to −2 volts.

5. The golf ball of claim 1, wherein said at least one layer has a thickness of 1.5 mm to 2.5 mm, and said at least one layer comprises a multilayer for said cover.

6. The golf ball of claim 1, wherein a shore D hardness of said cover has a value of 40 to 70.

7. The golf ball of claim 1, wherein said golf ball has a diameter of not less than 42.67 mm and a weight of not greater than 45.93 grams.

8. The golf ball of claim 1, further comprising a paint coating on an outer surface of said cover, wherein said paint coating is dried at a temperature range of 35 to 70 degrees Celsius for a time period between 20 minutes and 24 hours.

9. The golf ball of claim 8, wherein said temperature range is 40 to 60 degrees Celsius and said time period is 30 minutes to 8 hours.

10. The golf ball of claim 1, said at least one layer further comprising pigments, dispersants, antioxidants, UV absorbers and photo-stabilizers.

11. A golf ball, comprising:

a core; and a cover of at least one layer enclosing the core, said at least one layer being formed of a cover material comprising a heated mixture of an ionomer resin and a metal salt, said heated mixture exhibiting such a crystal melting behavior that when measured by a differential scanning calorimeter, a difference between a first peak temperature and a second peak temperature is up to 30° C., wherein said core and said cover are not subjected to annealing.

12. The golf ball of claim 11, wherein said difference is 10 degrees Celsius.

13. The golf ball of claim 11, wherein said difference is 26 degrees Celsius.

* * * * *